US007918987B2

(12) United States Patent
Lammers et al.

(10) Patent No.: US 7,918,987 B2
(45) Date of Patent: Apr. 5, 2011

(54) ELECTROCHEMICAL PROCESS TO PREPARE A HALOGENATED CARBONYL GROUP-CONTAINING COMPOUND

(75) Inventors: Hans Lammers, Arnhem (NL); Willem Koelewijn, Zwolle (NL); Johannes Wilhelmus Franciscus Lucas Seetz, Twello (NL); Joldert Faber, Arnhem (NL)

(73) Assignee: Akzo Nobel N.V., Arnhem (NL)

( * ) Notice: Subject to any disclaimer, the term of this patent is extended or adjusted under 35 U.S.C. 154(b) by 21 days.

(21) Appl. No.: 12/300,621

(22) PCT Filed: May 11, 2007

(86) PCT No.: PCT/EP2007/054599

§ 371 (c)(1),
(2), (4) Date: Nov. 12, 2008

(87) PCT Pub. No.: WO2007/131969

PCT Pub. Date: Nov. 22, 2007

(65) Prior Publication Data

US 2009/0107849 A1 Apr. 30, 2009

Related U.S. Application Data

(60) Provisional application No. 60/810,629, filed on Jun. 5, 2006.

(30) Foreign Application Priority Data

May 15, 2006 (EP) ..... 06113942

(51) Int. Cl.
*C25B 3/06* (2006.01)

(52) U.S. Cl. ..... 205/459

(58) Field of Classification Search ..... 205/439, 205/440, 441, 443, 446, 459, 442
See application file for complete search history.

(56) References Cited

FOREIGN PATENT DOCUMENTS

GB 1 026 187 4/1966

OTHER PUBLICATIONS

Okimoto et al., "Electrooxidation of Malonate and Acetylacetate Derivatives in the Presence of Halide Ions", Synthesis (Nov. 2002), vol. 15, pp. 2215-2219.*

M.A. Youtz et al., "Depolarization of the chlorine electrode by organic compounds," *J. Am. Chem. Soc.*, vol. 46, pp. 545-554, (1924).

P. Sartori et al., "The actual state of our knowledge about mechanism of electrochemical fluorination in anhydrous hydrogen fluoride (Simons process)," *Journal of Fluorine Chemistry*, vol. 87, pp. 157-162, (1998).

(Continued)

*Primary Examiner* — Edna Wong
(74) *Attorney, Agent, or Firm* — Kenyon & Kenyon LLP

(57) ABSTRACT

The present invention provides a process to prepare a halogenated carbonyl group-containing compound by electrochemically reacting the corresponding carbonyl group-containing compound with a hydrogen halide H—X, an organic halide R'—X and/or a halide salt $M^{n+}$—$X_n^-$ under substantially water-free conditions, wherein X is a chlorine, bromine or iodine atom, R' is an alkyl or aryl group that may be linear or branched, optionally containing one or more heteroatoms such as oxygen, nitrogen, chloride, bromide, fluoride or iodide of which the halogen atom X can be electrochemically split off, $M^{n+}$ is a quaternary ammonium, alkaline earth metal, alkali metal or metal cation, and n is an integer of 1 to 5, depending on the valency of the metal cation $M^{n+}$.

20 Claims, 1 Drawing Sheet

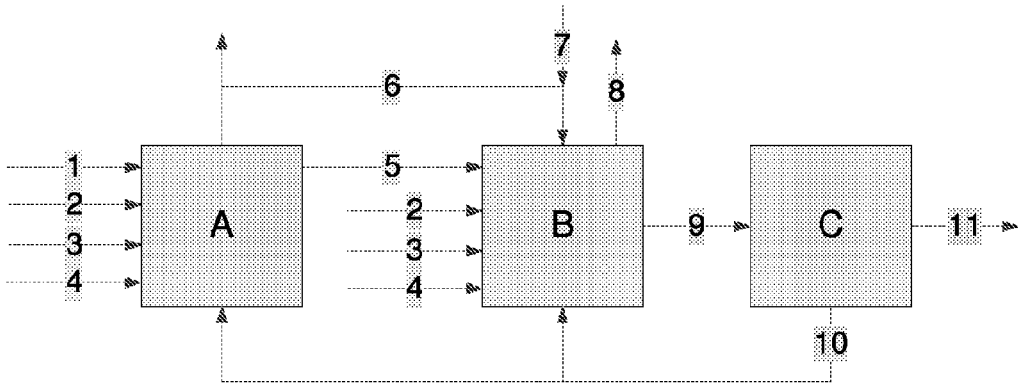

Apparatus for the preparation of halogenated carbonyl derivatives according to the invention, using a chemical reactor (A), an electrochemical reactor (B), and a physical separation unit (C).

OTHER PUBLICATIONS

A.J. Bard et al., "Encyclopedia of Electrochemistry," *Organic Electrochemistry*, vol. 8, Chapters 2.3.1 and 2.4.1, pp. 31 and 39, (2004).
L.N. Nekrasov et al., "Effect of Small Amounts of Tetramethyl- and Tetraethylammonium Ions on Electroreduction Kinetics of Certain Organic Compounds in Solutions of Tetrabutylammonium Salts," *Elektrokhimiya*, vol. 24, No. 4, pp. 560-563, (1988).
A. Inesi et al., "Electrochemical Reduction of Halogen Containing Compounds at a Mercury Cathode: Chloroacetic Dichloroacetic Acids and Corresponding Ethylesters in Dimethylformamide," *Electroanalytical Chemistry and Interfacial Electrochemistry*, vol. 44, pp. 25-35, (1973).
Weast et al., "Fats and Oils," *CRC Handbook of Chemistry and Physics*, D-220, (1989).
Dennis G. Peters, "Halogenated Organic Compounds," *Organic Electrochemistry*, 4th Ed., Chapter 8, pp. 341-377, (2001).
F. Beck, "Electroorganische Chemie," *Verlag Chemie GmbH, Weinheim*, Chapter 3.3, pp. 104-110, (1974).
D. Pletcher, "A First Course in Electrode Processes," *The Electrochemical Consultancy*, Alresford Press Ltd., Chapter 2.3, pp. 57-72, (1991).
International Search Report and Written Opinion of the International Searching Authority, PCT International Application No. PCT/EP2007/054599, dated Mar. 19, 2008.

* cited by examiner

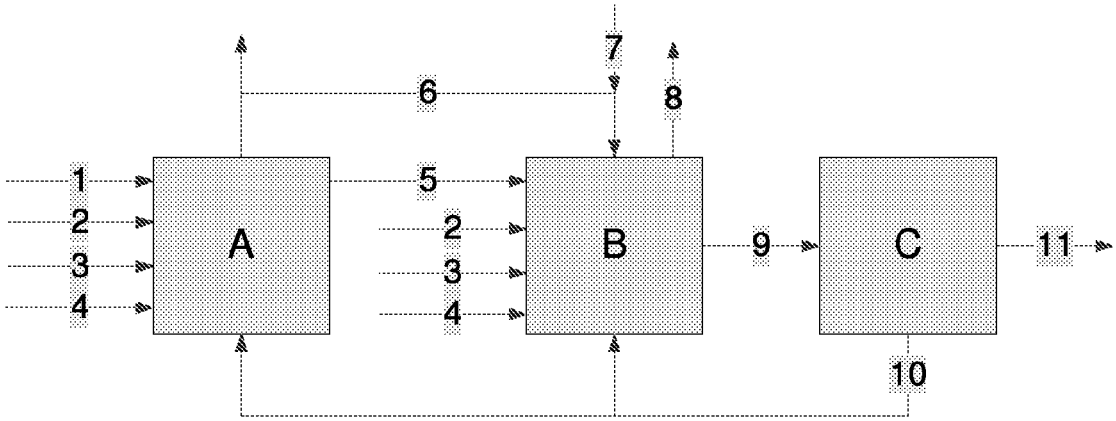

Figure 1: Apparatus for the preparation of halogenated carbonyl derivatives according to the invention, using a chemical reactor (A), an electrochemical reactor (B), and a physical separation unit (C).

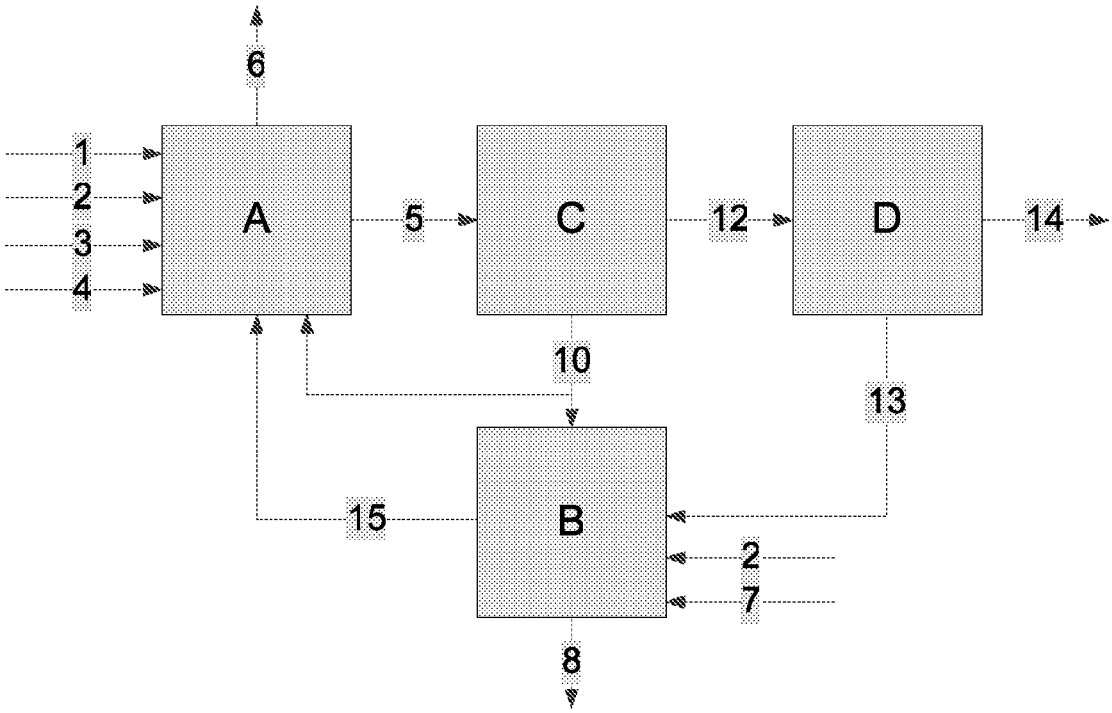

Figure 2: Apparatus for the preparation of halogenated carbonyl derivatives according to the invention, using a chemical reactor (A), an electrochemical reactor (B), a physical separation unit (C), and a separation unit for separating monohalogenated compounds from the corresponding di- and higher halogenated compounds (D).

ELECTROCHEMICAL PROCESS TO PREPARE A HALOGENATED CARBONYL GROUP-CONTAINING COMPOUND

REFERENCE TO RELATED APPLICATION(s)

Field of Invention

This invention relates to a novel electrochemical process to prepare a halogenated carbonyl group-containing compound, such as a carboxylic acid. In a specific embodiment, it relates to the chlorination of acetic acid to manufacture monochloroacetic acid.

BACKGROUND OF INVENTION

In the industry monochloroacetic acid is prepared by reacting acetic acid with chlorine. Such a process for the preparation of monochloroacetic acid is commonly known and generally makes use of a reactor in which a mixture of liquid acetic acid (HAc) is reacted with chlorine gas under anhydrous conditions. A large number of compounds can be used to create these anhydrous conditions. If acetic anhydride is used, this will immediately be converted with hydrochloric acid into acetyl chloride, which is the catalyst for this process. The process generally is conducted at a pressure of from 1 to 6 barA and a temperature of from 80 to 180° C. In the reactor, monochloroacetic acid (MCA) and gaseous HCl are formed together with by-products of which dichloroacetic acid (DCA) and trichloroacetic acid (TCA) are examples.

After the MCA-containing reaction product mixture has passed the reactor(s) and the catalyst recovery section, DCA is present in a significant amount, typically about 3-10%. The MCA/DCA-containing product mixture is subsequently led to a unit to reduce the amount of DCA in the MCA. This can be done by a physical separation, such as melt crystallization, or by a chemical conversion, such as a reduction where DCA is reduced with hydrogen in the presence of a hydrogenation catalyst, e.g. a metal-based catalyst. This catalyst not only reduces DCA, but also reduces MCA to some extent, which is of course undesirable. Moreover, such a reduction unit and its operation are expensive, and this adds to the production costs of the MCA end product.

The low-boiling components are then removed from the MCA by conventional vacuum distillation.

A process to prepare MCA by an electrochemical process has been disclosed by A. Youtz et al., "Depolarization of the Chlorine Electrode by Organic Compounds" in *J. Am. Chem. Soc.,* 1924, 46, 549. The process encompasses the reaction of 70% acetic acid in an aqueous solution with hydrochloric acid to give chloroacetic acid.

An electrochemical process to prepare a halogenated carboxylic acid (derivative) in an aqueous environment has the disadvantage that only a low amount of the desired (mono) halogenated carboxylic acid is formed. Besides, in an aqueous chloride environment the main product of electrolysis is often chlorine gas, which is undesirable, as it represents an additional waste stream and besides the combination of chlorine gas and hydrogen gas may make the reaction's off-gas mixture explosive.

SUMMARY OF INVENTION

It is an object of the invention to provide a process to prepare a halogenated carbonyl group-containing compound using starting materials that are cheap and available on a large scale, while at the same time no after-treatment is needed for the co-produced compound(s). It is a further object of the present invention to provide a process which yields a monohalogenated carbonyl group-containing compound having a lower di- tri- or polyhalogenated side product content relative to the above-described industrial process. Also, it is an object of the invention to provide a process that can be easily integrated into the existing hardware used for the state of the art industrial process described above, while not requiring severe physical conditions. It is a further object to provide a process producing a carbonyl group-containing compound that is selectively halogenated at the α-carbon atom (i.e. the carbon atom adjacent to the carbonyl group). It is yet a further objective to provide a process that gives an improved yield of product, e.g. when compared to the aqueous electrochemical process of Youtz et al., and that provides a side product of good value.

The present invention now provides a process to prepare a halogenated carbonyl group-containing compound by electrochemically reacting the corresponding carbonyl group-containing compound with a hydrogen halide H—X, an organic halide R'—X and/or a halide salt $M^{n+}$—$X_n^-$ under substantially water-free conditions, wherein X is a chlorine, bromine or iodine atom, R' is an alkyl or aryl group that may be linear or branched, optionally containing one or more heteroatoms such as oxygen, nitrogen, chloride, bromide, fluoride or iodide of which the halogen atom X can be electrochemically split off, $M^{n+}$ is a quaternary ammonium, alkaline earth metal, alkali metal or metal cation, and n is an integer of 1 to 5, depending on the valency of the metal cation $M^{n+}$.

Substantially water-free conditions are defined as having less than 1 wt % water in the reaction mixture, preferably less than 0.1 wt %, more preferably about zero; most preferably, the conditions are fully anhydrous, which is achieved when the reaction mixture contains compounds that act as water scavengers.

Surprisingly, the halogen X can only be selected from the group of chlorine, bromine, and iodine, as fluorination is not possible using the process of this invention. In the state of the art, see e.g. P. Sartori, N. Ignat'ev, "The Actual state of our knowledge about mechanism of electrochemical fluorination in anhydrous hydrogen fluoride (Simons process)", *Journal of Fluorine Chemistry* 87 (1998), pp. 157-162, a process for fluorinating several organic compounds is disclosed; however, these reactions normally are carried out such that they give a polyfluorination and do not lead to a specific α-carbon fluorination either.

When using the process of the invention no halogen gas (such as chlorine gas) is needed, but instead use can be made of hydrogen halide, organic halides or halide salts, which in general are much more widely available and cheaper than the starting materials of the current industrial process. The process of the present invention gives the halogenated carbonyl group-containing compound and hydrogen as reaction products. Any unreacted halide source can be easily recycled and the same applies for unreacted carbonyl group-containing compound. The side product hydrogen that is formed is easily isolatable and can be used as, e.g., an energy source or a starting compound for other chemical processes, hence it represents a commercial value.

Surprisingly, it was found that only a very insignificant amount of di- and/or higher halogenated carbonyl group-containing compound was formed; typically when halogenating a carboxylic acid the amount of dihalogenated carboxylic acid was found to be below 0.3 wt % and the amount of trihalogenated or higher halogenated carboxylic acid, if formed at all, was found to be below the detection limit (i.e.

50 ppm). As the side product of the reaction is hydrogen gas (i.e. bubbles), the reaction mixture remains well mixed and stirring is not needed, which is beneficial as well.

In the process of the invention, electric current yields to produce mono-halogenated carboxylic acid (derivative) of 80% have been achieved. It is expected that even higher current yields are achievable. In contrast, electrochemical chlorination of acetic acid in an aqueous environment results in low current yields of typically below 1%.

Current yield (also called current efficiency) is described in Bard-Stratman, *Encyclopedia of Electrochemistry, Organic Electrochem*., Vol. 8, Chapter 2.3.1, p. 31, to which reference is made. In a few words, current efficiency or current yield means the fraction of the electrical cell current—or (integrated over time) the fraction of the transferred charge—which is used to form the product.

Surprisingly, it was found that in the process of the invention also di- and/or higher halogenated carbonyl group-containing compounds are effectively converted into the monohalogenated carbonyl group-containing compound. Accordingly, in one embodiment, the starting material can be a mixture of compounds comprising at least di- and/or higher halogenated carbonyl group-containing compounds (R'—X) and a non-halogenated carbonyl group-containing compound wherein the amount of di- and/or higher halogenated carbonyl group-containing compound preferably is at most equimolar to the amount of non-halogenated carbonyl group-containing compound. It was found that using such a starting mixture still results in a reaction product comprising primarily monohalogenated carbonyl group-containing compound, or in other words, an extremely low amount of di- and/or higher halogenated carbonyl group-containing compound. Hydrogen halide is prepared in situ as a result of the electrochemical reaction of the di- and/or higher halogenated carbonyl group-containing compound at the cathode under electrochemical conditions.

In two documents, i.e. L. N. Nekrasov et al., "Effect of small amounts of tetramethyl- and tetraethylammonium ions on electroreduction kinetics of certain organic compounds in solutions of tetrabutylammonium salts", *Elektrokhimiya*, Vol. 24, No. 4, pp. 560-563, 1988 and A. Inesi, L. Rampazzo, "Electrochemical reduction of halogen containing compounds at a mercury cathode: chloroacetic, dichloroacetic acids and corresponding ethylesters in dimethylformamide", *Electroanalytical Chemistry and Interfacial Elelctrochemistry,* 44 (1973), pp. 25-35, it is disclosed that trichloroacetic acid can be reduced to dichloroacetic acid by using an electrochemical process, but it is neither disclosed nor suggested that this compound can be used as a halogen source (i.e. as the defined compound R'—X) for the halogenation of a carbonyl-group containing compound to prepare the monohalogenated carbonyl-group containing compound.

Hence, in one embodiment the invention provides a process wherein the organic halide R'—X is a di- and/or higher halogenated carbonyl group-containing compound, or in other words; a process to prepare a halogenated carbonyl group-containing compound by electrochemically reacting the corresponding carbonyl group-containing compound with a di- and/or higher halogenated carbonyl group-containing compound, optionally a hydrogen halide H—X, a further organic halide R'—X and/or a halide salt $M^{n+}$—$X_n^-$, under substantially water-free conditions, wherein X is a chlorine, bromine or iodine atom, R' is an alkyl or aryl group that may be linear or branched, optionally containing one or more heteroatoms such as oxygen, nitrogen, chloride, bromide, fluoride or iodide of which the halogen atom X can be electrochemically split off, $M^{n+}$ is a quaternary ammonium, alkaline earth metal, alkali metal or metal cation, and n is an integer of 1 to 5, depending on the valency of the metal cation $M^{n+}$.

The process of the invention can also be used as a second step in a conventional process to prepare a monohalogenated carbonyl group-containing compound by the chemical reaction of a carbonyl group-containing compound and a halogen source. Also, the process of the invention can be used to treat the mother liquor that results when, e.g., a monohalogenated carboxylic acid (derivative) is separated from a reaction mixture comprising both monohalogenated and di- and/or higher halogenated carboxylic acids (derivatives), such mother liquor then comprising a mixture of remaining monohalogenated carboxylic acid (derivative) and a relatively high amount of di- and/or higher halogenated carboxylic acids (or derivatives thereof).

Separation methods include the usual separation methods available to the skilled person like distillation, extraction, and crystallization, of which crystallization is most preferred.

In this respect the invention provides a process to prepare a halogenated carbonyl group-containing compound by first chemically reacting the carbonyl group-containing compound with chlorine, bromine or iodine molecules and subsequently electrochemically treating the reaction mixture in accordance with the above-disclosed electrochemical process, and the invention provides a process wherein the starting mixture is the mother liquor acquired when a monohalogenated carbonyl group-containing compound is separated from a reaction mixture containing both a monohalogenated carbonyl group-containing compound and a di- and/or higher halogenated carbonyl group-containing compound.

In the process with a mixture of a carbonyl group-containing compound and the corresponding di- and/or higher halogenated carbonyl group-containing compound, the net reaction is that of the di- and/or higher halogenated carbonyl group-containing compound with the corresponding carbonyl group-containing compound to give the monohalogenated carbonyl group-containing compound.

The embodiment comprising a conventional process followed by an electrochemical process according to the invention has as an important advantage that the products of the conventional process (i.e. hydrogen halide and a mixture of carbonyl group-containing compound, monohalogenated carbonyl group-containing compound, and di- and/or higher halogenated carbonyl group-containing compound) are the starting materials of the electrochemical step. Therefore, processing the product stream of the conventional process is not needed; instead, the product stream of the conventional process can be used directly as starting material stream in the electrochemical step.

Suitably, higher halogenated means that up to 10, and preferably 3 to 6, chlorine, bromine and/or iodine groups are present in the carbonyl group-containing compound.

BRIEF DESCRIPTION OF DRAWINGS

FIG. 1 shows an apparatus for the preparation of halogenated carbonyl derivatives according to the invention, using a chemical reactor (A), an electrochemical reactor (B), and a physical separation unit (C).

FIG. 2 shows an apparatus for the preparation of halogenated carbonyl derivatives according to the invention, using a chemical reactor (A), an electrochemical reactor (B), a physical separation unit (C), and a separation unit for separating monohalogenated compounds from the corresponding di- and higher halogenated compounds (D).

DETAILED DESCRIPTION

The invention further provides an apparatus for performing the above processes. In this respect an apparatus is provided which comprises a chemical reactor (A), connected to an electrochemical reactor (B) via an outlet (5) and optionally outlets (2), (3), and (4), with the reactor (B) being connected to a physical separation unit (C) via an outlet (9). The apparatus is illustrated in FIG. 1.

The chemical reactor (A) can be a reaction vessel (e.g. heated and/or cooled and/or insulated) of a suitable material (e.g. glass-lined steel). Preferably, the chemical reactor contains internal means such as mechanical stirrers, heat exchanger tubes, inlet pipes (e.g. for raw materials and recycle streams), and/or contains sensors (such as temperature sensors, pressure sensors, liquid level sensors). Optionally, the chemical reactor (A) may be provided with a UV irradiating means to convert halogen gas into a halogen atom, such as a UV lamp.

Referring to FIG. 1 in more detail, a halide, a carbonyl group-containing compound, optionally a catalyst, and optionally an electrolyte are supplied to the chemical reactor (A) via inlets (1), (2), (3), and (4), respectively, of which two or more may be combined into one inlet to react to an intermediate product, which is supplied to the electrochemical reactor (B) via outlet (5). Gaseous components formed in and separated from the chemical reactor (A) may optionally be partially or fully introduced into the electrochemical reactor (B) as well via outlet (6), in which case outlet (6) may be combined with outlet (5) into one outlet. Optionally, more or even all of the carbonyl group-containing compound, catalyst, and electrolyte may be fed to the electrochemical reactor (B) via inlets (2), (3), and (4), respectively, of which two or more may be combined into one inlet. In one embodiment, the electrochemical reactor (B) may be provided with an additional inlet stream (7) containing a halide (gas or liquid).

The electrochemical reactor (B) is an apparatus containing at least one anode and at least one cathode of any suitable material as described hereinbefore and is preferably a vessel where the anode(s) and the cathode(s) are placed in a suitable geometry (such as parallel plates or concentric cylinders, packed or fluid bed cells). In a more preferred embodiment, the electrochemical reactor contains one or more cell separators such as diaphragms or membranes. In another preferred embodiment, the electrochemical reactor (B) is a reactor containing parallel electrodes in a vessel with or without internal or external fluid recirculation. The anode and the cathode are connected to a direct current power supply that supplies electric current to the electrodes. The electrodes can be connected to the electric power supply in monopolar or in bipolar arrangement. In a preferred embodiment, the electrochemical reactor (B) simultaneously produces monohalogenated compounds by halogenation of the raw materials at the anode and dehalogenation of di- and higher halogenated compounds at the cathode. In some embodiments, the hydrogen gas in the electrochemical reactor is produced at the cathode that is separated from the reactor through outlet (8).

The substantially reduced di- and/or higher halogenated product from the electrochemical reactor (B) is supplied to the physical separation unit (C) via outlet (9). Hydrogen halide and other components formed in the chemical reactor (A) and/or the electrochemical reactor (B) are separated from the product through outlet (11), and optionally returned to the chemical reactor (A) and/or the electrochemical reactor (B) via outlet (10). In addition, electrolyte may be fed to the chemical reactor (A) and/or the electrochemical reactor (B) via inlet (4), which electrolyte can be separated from the reaction products and the reactants in the physical separation unit (C) and may optionally be returned to the reactors A and B via outlets (10).

The physical separation unit (C) is an apparatus that may comprise one or more distillation columns, extraction columns, absorption columns or a combination of these suitable for separating the electrochemical reactor product entering the unit C via outlet (9) into a halogenated product stream containing mainly mono- and di-halogenated carbonyl derivative exiting the apparatus of the invention through outlet (11).

In another embodiment, the apparatus comprises an additional separation unit (D) for separating monohalogenated compounds from the corresponding di- and higher halogenated compounds. The apparatus is illustrated in FIG. 2.

Referring to FIG. 2 in more detail, in the apparatus of this embodiment the product from the chemical reactor (A) is introduced to a physical separation unit (C) via outlet (5), as described above, to separate the electrolyte and other components or products formed in the chemical reactor A from the mixture of mono, di- and/or higher halogenated carbonyl products transported to the separation unit D via outlet (12).

The separation unit D comprises separation means capable of separating monohalogenated compounds from the corresponding di- and higher halogenated compounds. These separation means may be distillation columns, crystallization units, extraction unit or any combination of these to provide the required separation. The unit D produces the purified monohalogenated product separated via outlet (14) and a stream substantially enriched in di- and/or higher halogenated product, which is introduced into an electrochemical reactor (B) described above via outlet (13).

In the apparatus of the embodiment illustrated in FIG. 2, the product from the electrochemical reactor (B), which is substantially enriched in monohalogenated product, may be introduced into the chemical reactor (A) via outlet (15). Optionally, a stream containing electrolyte and other components from the physical separation unit (C) is introduced into the electrochemical reactor (B) and/or the chemical reactor (A) via outlet (10). Optionally, a stream containing halide (gas or liquid) and a stream containing carbonyl group-containing compounds may be introduced into the electrochemical unit (B) as well via inlets (7) and (2), respectively, which may be combined into one inlet. In the electrochemical reactor (B) hydrogen gas may be produced at the cathode and separated from the reactor through outlet (8).

In a preferred embodiment, the process of the invention is performed in the substantial absence of solvent. By "in the substantial absence of solvent" is meant that at most 5% solvent is present in the reaction mixture. The term solvent is meant to cover any substance in which at least the starting materials of the reaction are soluble but does not include one of the reactants/products. More preferably, in the process of the invention the reaction mixture contains less than 2% solvent. Most preferably, about 0% solvent is present.

The net chemical reactions taking place in the process of the invention are understood to be

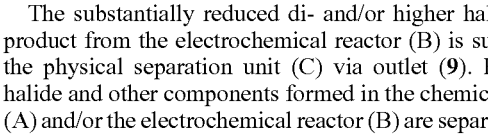

$$H—X+R—COY \rightarrow X—R—COY+H_2$$

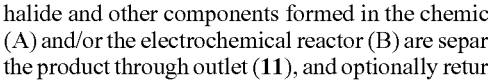

$$R'—X+R—COY \rightarrow X—R—COY+R'—H \text{ or}$$

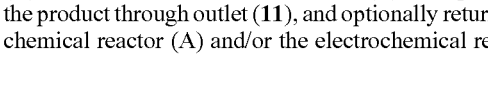

$$MX_n+nR—COOH \rightarrow (X—R—COO)_nM+nH_2$$

The carbonyl group-containing compound R—COY or R—COOH to be halogenated can be any compound that contains an α-carbon hydrogen atom, preferably liquid at the reaction temperature. The carbonyl group-containing compound R—COY can be an aldehyde, a ketone, a carboxylic acid, a carboxylic anhydride, or an acyl halide. Preferably, R—COY and R—COOH are carbonyl group-containing compounds wherein R is an alkyl, alkylene or aryl group having α-hydrogens and may be linear, cyclic or branched, optionally containing one or more heteroatoms such as oxygen, nitrogen, chloride, bromide or iodide, and Y is hydrogen, a hydroxyl group, a halide atom, or a group R", or OCOR", wherein each R" independently is a hydrogen atom or an alkyl, alkylene or aryl group. More preferably, Y is a hydroxyl group, a halide atom, a group R" or OCOR", wherein R" is a $C_1$-$C_{10}$ alkyl or $C_1$-$C_{10}$ alkylene, and R is a $C_1$-$C_{26}$ alkyl or $C_1$-$C_{26}$ alkylene group. Even more preferably, the carbonyl group-containing compound is a non-substituted $C_2$-$C_{26}$ carboxylic acid, more preferably still acetic acid, propanoic acid or a fatty acid, most preferably acetic acid. Fatty acid is defined as a carboxylic acid with hydrocarbyl groups containing 1-22 carbon atoms, preferably 8 to 22 carbon atoms, which could be saturated or unsaturated, linear or branched. Fatty acids derived from natural fats and oils are assumed to have at least 8 carbon atoms. Preferred fatty acids in the present invention are unbranched $C_8$-$C_{26}$ carboxylic acids and even more preferred is the group of natural fatty acids as specified, e.g., in *CRC Handbook of Chemistry and Physics,* 1989 ed., D-220.

The halide is chloride, bromide or iodide, more preferably it is chloride or bromide, most preferably chloride.

The organic halide R'—X may be any compound that can be dehalogenated by an electrochemical step, such as for example disclosed in Lund, Hamerich, *Organic Electrochemistry,* 4th ed., Chapter 8, "Halogenated organic compounds" (Marcel Dekker, 2001). R'—X preferably is a halogenated hydrocarbon compound that may contain further substituents like nitrogen or oxygen. Most preferably, R'—X is a di- and/or higher halogenated carbonyl group-containing compound.

The halide salt $M^{n+}$—$X_n$ preferably is a halide salt wherein M is an alkaline earth metal, alkali metal or metal cation, more preferably M is a Na, K, Li, Mg, Ca, Ba cation, even more preferably an alkali metal cation, most preferably a lithium, sodium or potassium cation.

In an even more preferred embodiment, the reaction mixture essentially comprises only reactants, products, and auxiliary agents, i.e. more than 95 wt % of the reaction mixture is starting materials, products, and auxiliary agents, and most preferably more than 99 wt % is comprised thereof. Auxiliary agents are defined as agents that may be functionally present in the process of the invention, such as the catalyst and the supporting electrolyte.

In principle, a supporting electrolyte is not needed in the process, as long as sufficient current can be passed through the fluid under the process conditions.

In a preferred embodiment a supporting electrolyte is present in the reaction mixture. This electrolyte is a (mixture of) non-aqueous compound that is sufficiently soluble and provides sufficient conductivity in the applied reaction mixture, can easily be separated and recycled, and is sufficiently stable against oxidation and reduction. Examples of such supporting electrolytes can be any combinations of ions given in, e.g., F. Beck, *Elektroorganische Chemie*, Verlag Chemie GmbH, Weinheim, 1974, Chapter 3.3, pp. 104-110 or D. Pletcher, *A First Course in Electrode Processes, The Electrochemical Consultancy*, Alresford Press Ltd., 1991, Chapter 2.3, pp. 57-72, and may include ions such as $OH^-$, $I^-$, $Br^-$, $Cl^-$, $F^-$, $NO_3^-$, $SO_4^{2-}$, $HCO^{3-}$, $Fe(CN)_6^{3-}$, $ClO_4^-$, $BF_4^-$, $PF_6^-$, $H^+$, $Li^+$, $Na^+$, $K^+$, $Rb^+$, $Ca^{2+}$, $Mg^{2+}$, $Al^{3+}$, $La^{3+}$, $Ag^+$, $NH_4^+$, $[N(CH_3)_4]^+$, $[N(C_2H_5)_4]^+$, $[N(C_4H_9)_4]^+$, $[N(C_2H_5)H]^+$. More preferably, the electrolyte is a salt that is soluble in the carboxylic acid to be halogenated and either does not participate in the halogenation reaction or does so participate but then contains the same halogen anion as the halogen source in the reaction in order to prevent the formation of different halogenated carbonyl group-containing compounds. In an even more preferred embodiment, the electrolyte is a halide salt such as NaCl, NaBr, NaI, KCl, KBr, KI, LiCl, LiBr, LiI, $MgCl_2$, $MgBr_2$, $MgI_2$, $CaCl_2$, $CaBr_2$, $CaI_2$, $BaCl_2$, $BaBr_2$, $BaI_2$. In the most preferred embodiment, the metal salt $MX_n$ functions as the supporting electrolyte.

In another preferred embodiment, a reaction accelerating compound (herein also referred to as "catalyst") is present in the reaction mixture. In a more preferred embodiment, this compound is the anhydride of the carboxylic acid (derivative) to be halogenated or the acid halide thereof. In the embodiment comprising a two step process, i.e. a chemical halogenation step followed by an electrochemical step, the aforementioned acid halide catalyst may be formed in the reaction mixture, and thus need not be added, by using a product such as $PCl_3$ or $SOCl_{or\ SO2}Cl_2$, $COCl_2$, acid anhydride or sulfur (as catalyst) in the chemical step. As already indicated briefly above, these acid anhydride and acid halide types of compounds have as an additional advantage that they scavenge water to give to the carboxylic acid and thus are able to make the reaction conditions fully anhydrous. The catalyst is used in typical amounts of between 2 and 30 wt % on the total reaction mixture.

An additional advantage of the process of the invention is that because the electrochemical reaction is carried out in a non-aqueous environment, the catalyst compound is not degraded by water present in the reaction mixture.

The electrodes used can be selected from any material, as long as they do not degrade in the reaction mixture under the reaction conditions to give rise to undesired side products. In this respect, especially the selection of the material of the anode is of importance, as the anode is most susceptible to degradation during the process conditions. In a preferred embodiment, the anode is of carbon (such as boron doped diamond, graphite, vitreous carbon), ceramics (such as magnetite, i.e. $Fe_3O_4$ or Ebonex®, i.e. mixed titanium oxides), a metal alloy (such as platinum/ruthenium) or a noble metal (such as Au, Ag, Pd. Pt, Ti), optionally containing a mixed metal oxide such as $IrO_2/RuO_2$ (e.g. $IrO_2/RuO_2$ on titanium, Dimension Stable Anodes: DSA® electrodes), and the cathode is of carbon (such as boron doped diamond, graphite, vitreous carbon), metals (such as nickel, lead, mercury, titanium, iron, chromium), a metal alloy (such as stainless steel (Cr—Ni—Fe), Monel (Cu—Ni), brass (Cu—Zn) or metal oxides (such as Pb/PbO2) or any other electrode as long as it is stable in the system and does not produce significant amounts of unwanted by-products. Examples of electrode materials are mentioned in A. J. Bard and M. Stratmann, Eds., *Encyclopedia of Electrochemistry, Organic Electrochem.*, Vol. 8, Chapter 2.4.1, p. 39, to which reference is made.

Additionally, in the process of the invention the electrodes are preferably selected such that the specific surface area thereof is as high as possible and the distance between the cathode and the anode is as small as possible. The person skilled in the art will have no problem selecting electrodes suitable for this purpose. As non-limiting examples of electrodes that satisfy one or more of the above criteria may be mentioned concentric electrodes, porous electrodes, parallel plate electrodes, packed bed electrodes, fluidized bed electrodes. The electrode arrangement can be monopolar or bipolar.

The electric current density during the process of the invention typically is between 0.1 and 7 kA/m$^2$, preferably between 0.5 and 4 kA/m$^2$, and most preferably between 1 and 2 kA/m$^2$. The cell voltage typically is between 1 and 10 Volts, depending mainly but not exclusively on the applied current density, the conductivity of the reaction fluid, and the distance between the electrodes The process of the invention can be combined with a UV treatment step by which halogen gas is added to the reaction system, converted into a halogen atom by UV irradiation, and also rendered able to react with the carbonyl group-containing compound to give the halogenated carbonyl group-containing compound desired.

The process of the invention can be a batch, semi-batch or continuous process; preferably, it is a continuous process.

The process can be performed at a pressure that typically ranges from 1 to 10 barA; preferably, the pressure is between 0.9 and 5 barA, most preferably about 1-2 barA. BarA means bar absolute.

The process is generally performed at a temperature of between 11 and 200° C., preferably between 20 and 150° C., more preferably between 75 and 140° C., most preferably between 80 and 120° C.

The invention is further illustrated by the following examples and comparative examples

EXAMPLES

Example 1

Chlorination of Acetic Acid using HCl

In a reactor vessel containing graphite anodes and cathodes (material type 6503, Le Carbonne Lorraine, Rotterdam, The Netherlands) with 580 cm$^2$ of effective anode area and 530 cm$^2$ of effective cathode area, an amount of 800 grams of a mixture containing 7 wt % anhydrous calcium chloride (J. T. Baker, no. 0070, min. 95 wt %), 69% acetic acid (Fluka, no. 45731, >99.8 wt %), and 24 wt % acetyl chloride (Fluka, no. 00990, >99%) was preheated to 70° C. and electrolyzed at an average current of 20 amperes. During the electrolysis process, hydrogen chloride gas was added to the reaction mixture.

Samples taken from the electrolyte during the electrolysis process were analyzed by high performance liquid chromatography (HPLC).

Table 1 shows the monochloroacetic acid (MCA) and dichloroacetic acid (DCA) concentrations measured by HPLC (in wt % relative to the sum of the amounts of acetic acid (HAc), MCA, and DCA) versus the amount of electric charge transferred during the process.

TABLE 1

Concentrations of monochloroacetic acid (MCA) and dichloroacetic acid (DCA) versus the amount of electric charge transferred during electrolysis of a mixture that at the start contains acetic acid, acetyl chloride, calcium chloride, and hydrogen chloride (Example 1)

| Sample | Charge transferred [A-h] | MCA content [wt %] | DCA content [wt %] |
|---|---|---|---|
| 1 | 5 | 0.6 | 0.003 |
| 2 | 16 | 2.6 | 0.007 |
| 3 | 34 | 7.1 | 0.013 |
| 4 | 51 | 10.7 | 0.020 |
| 5 | 59 | 12.3 | 0.024 |

TABLE 1-continued

Concentrations of monochloroacetic acid (MCA) and dichloroacetic acid (DCA) versus the amount of electric charge transferred during electrolysis of a mixture that at the start contains acetic acid, acetyl chloride, calcium chloride, and hydrogen chloride (Example 1)

| Sample | Charge transferred [A-h] | MCA content [wt %] | DCA content [wt %] |
|---|---|---|---|
| 6 | 78 | 16.1 | 0.029 |
| 7 | 107 | 21.6 | 0.044 |
| 8 | 140 | 27.4 | 0.054 |

Example 2

Chlorination of Acetic Acid using $CaCl_2$ (in the Absence of HCl)

In the reactor as mentioned in Example 1, 650 grams of a mixture of 72 wt % acetic acid (Fluka, no. 45731, >99.8 wt %), 21 wt % acetyl chloride (Fluka, no. 00990, >99%), and 7 wt % of anhydrous calcium chloride (J. T. Baker, no. 0070, min. 95 wt %) were preheated to 70° C. and electrolyzed at an electric current between 5 and 20 amperes. In contrast to Example 1, in the present example no hydrogen chloride gas was added to the reaction mixture.

Samples taken from the electrolyte during the electrolysis process were analyzed by high performance liquid chromatography (HPLC).

Analytical results show that MCA can be produced from the mixture also in the absence of hydrogen chloride.

Table 2 shows the monochloroacetic acid (MCA) and dichloroacetic acid (DCA) concentrations measured by HPLC (in wt % relative to the sum of the amounts of acetic acid (HAc), MCA, and DCA) versus the amount of electric charge transferred during the process.

TABLE 2

Concentrations of monochloroacetic acid (MCA) and dichloroacetic acid (DCA) versus the amount of electric charge transferred during electrolysis of a mixture that at the start contains acetic acid, acetyl chloride, and calcium chloride (Example 2)

| Sample | Charge transferred [A-h] | MCA content [wt %] | DCA content [wt %] |
|---|---|---|---|
| 1 | 0.5 | 0.6 | 0.003 |
| 2 | 2.6 | 1.4 | 0.007 |
| 3 | 7.3 | 2.7 | 0.010 |
| 4 | 12.5 | 4.1 | 0.018 |
| 5 | 16.8 | 5.0 | 0.019 |
| 6 | 26.6 | 7.6 | 0.026 |

Example 3

Chlorination of Acetic Acid using Dichloroacetic Acid

In the reactor as mentioned in Example 1, 700 grams of a mixture of 60 wt % acetic acid (Fluka, no. 45731, >99.8 wt %), 19 wt % acetyl chloride (Fluka, no. 00990, >99%), 5 wt % of anhydrous calcium chloride (J. T. Baker, no. 0070, min. 95 wt %), and 16 wt % of dichloroacetic acid (Acros Chemicals, Lot A0220473, 99+%) were preheated to 70° C. and electrolyzed at an electric current of 20 amperes. Hydrogen chloride gas was added to the reaction mixture.

Samples taken from the electrolyte during the electrolysis process were analyzed by high performance liquid chromatography (HPLC).

Analytical results show that compared to Example 2, the production rate of MCA is almost twice as high in the present example. Acetic acid is chlorinated and DCA is hydrogenated to MCA.

Table 3 shows the monochloroacetic acid (MCA) and dichloroacetic acid (DCA) concentrations measured by HPLC (in wt % relative to the sum of the amounts of acetic acid (HAc), MCA, and DCA) versus the amount of electric charge transferred during the process.

TABLE 3

Concentrations of acetic acid (HAc), monochloroacetic acid (MCA), and dichloroacetic acid (DCA) versus the amount of electric charge transferred during electrolysis of a mixture that at the start contains acetic acid, acetyl chloride, monochloroacetic acid, dichloroacetic acid, and calcium chloride (Example 3)

| Sample | Charge transferred [A-h] | HAc content [wt %] | MCA content [wt %] | DCA content [wt %] |
|---|---|---|---|---|
| 1 | 0.0 | 80.4 | 2.0 | 17.6 |
| 2 | 28 | 74.2 | 12.1 | 13.7 |
| 3 | 60 | 68.1 | 22.7 | 9.2 |
| 4 | 95 | 61.7 | 33.3 | 5.0 |
| 5 | 123 | 57.2 | 40.1 | 2.6 |
| 6 | 140 | 54.8 | 43.5 | 1.7 |

Example 4

Chlorination of Propionic Acid using HCl

In the reactor as mentioned in Example 1, 840 grams of a mixture of 65 wt % propionic acid (Fluka, lot no. 1241470, >99 wt %), 30 wt % propionic anhydride (Aldrich, lot no. 05003 HC-026, 97%), and 5 wt % of anhydrous calcium chloride (J. T. Baker, no. 0070, min. 95 wt %) were preheated to 70° C. and electrolyzed at an electric current between 1 and 9 amperes. During the electrolysis process, hydrogen chloride gas was added to the reaction mixture.

Samples taken from the electrolyte during the electrolysis process were analyzed by high performance liquid chromatography (HPLC).

Analytical results show that 1-chloropropionic acid can be produced from the mixture.

Table 4 shows the concentrations of propionic acid and 1-chloro-propionic acid measured by HPLC (in wt % relative to the sum of the amounts of propionic acid and 1-chloropropionic acid) versus the amount of electric charge transferred during the process.

TABLE 4

Concentrations of propionic acid and 1-chloropropionic acid versus the amount of electric charge transferred during electrolysis of a mixture that at the start contains propionic acid, propionic anhydride, and calcium chloride (Example 4)

| Sample | Charge transferred [A-h] | Propionic acid content [wt %] | 1-chloro-propionic acid [wt %] |
|---|---|---|---|
| 1 | 0.0 | 99.9 | 0.1 |
| 2 | 0.1 | 100.0 | 0.0 |

TABLE 4-continued

Concentrations of propionic acid and 1-chloropropionic acid versus the amount of electric charge transferred during electrolysis of a mixture that at the start contains propionic acid, propionic anhydride, and calcium chloride (Example 4)

| Sample | Charge transferred [A-h] | Propionic acid content [wt %] | 1-chloro-propionic acid [wt %] |
|---|---|---|---|
| 3 | 0.9 | 99.8 | 0.2 |
| 4 | 2.2 | 99.5 | 0.5 |
| 5 | 5.3 | 98.8 | 1.2 |
| 6 | 8.2 | 98.2 | 1.8 |
| 7 | 11.8 | 97.1 | 2.9 |
| 8 | 15.3 | 96.6 | 3.4 |
| 9 | 19.4 | 95.6 | 4.4 |
| 10 | 24.1 | 94.6 | 5.4 |
| 11 | 29.9 | 93.4 | 6.6 |
| 12 | 37.3 | 91.3 | 8.7 |

Comparative example 5 Chlorination of acetic acid in aqueous environment Into a 1-liter beaker a mixture containing 500 ml of hydrochloric acid (10 wt % HCl in water) was charged and electrolyzed at room temperature at a current of 2 amperes in order to produce chlorine gas. After two hours of electrolysis, 150 ml of acetic acid (70 wt %) was added to the reaction mixture, which was electrolyzed for another 1.5 hours at 2 amperes at room temperature.

Samples taken during the process were measured with $^{1}$H-NMR. Only trace amounts of MCA could be detected by NMR, the amount of DCA was below the detection limit (the detection limit of MCA and DCA with this NMR instrument is about 50 ppm).

Example 6

Preparation of Bromoacetic Acid Using LiBr

In a reactor vessel containing graphite anodes and cathodes (material type 6503 Le Carbonne Lorraine, Rotterdam, The Netherlands) with 580 cm$^2$ of effective anode area and 530 cm$^2$ of effective cathode area, an amount of 900 grams of mixture containing 11% anhydrous lithium bromide, 33% acetyl bromide, and 56% acetic acid (Fluka no. 00990, >99%) was preheated to 70° C. and electrolyzed at an average current of 20 amperes. Samples taken from the electrolyte during the electrolysis process were analyzed by high performance liquid chromatography (HPLC). After passing 83 A-h of charge through the electrodes, 12.97% bromoacetic acid and 0.017% dibromoacetic acid are formed.

Example 7

Chlorination of Acetic Acid using HCl and with Sodium Chloride as Electrolyte In a reactor vessel containing graphite anodes and cathodes (material type 6503 Le Carbonne Lorraine, Rotterdam, The Netherlands) with 580 cm$^2$ of effective anode area and 530 cm$^2$ of effective cathode area, an amount of 808 grams of mixture containing 11% anhydrous sodium chloride, 33% acetic anhydride, and 56% acetic acid (Fluka no. 00990, >99%) was preheated to 70° C. and electrolyzed at an average current of 3.8 amperes. During the electrolysis process hydrogen chloride gas was added to the reaction mixture. Samples taken from the electrolyte during the electrolysis process were analyzed by high performance liquid chromatography (HPLC). After passing 15.9 A-h of charge through the electrodes, 3.66% MCA and 0.043% DCA are formed.

Example 8

Chlorination of Acetic Acid using HCl with Lithium Chloride as Electrolyte

In a reactor vessel containing graphite anodes and cathodes (material type 6503 Le Carbonne Lorraine, Rotterdam, The Netherlands) with 580 $cm^2$ of effective anode area and 530 $cm^2$ of effective cathode area, an amount of 808 grams of mixture containing 1.3% anhydrous lithium chloride, 6.6% acetyl chloride, and 92.1% acetic acid (Fluka no. 00990, >99%) was preheated to 70° C. and electrolyzed at an average current of 20 amperes. During the electrolysis process hydrogen chloride gas was added to the reaction mixture. Samples taken from the electrolyte during the electrolysis process were analyzed by high performance liquid chromatography (HPLC). After passing 112 A-h of charge through the electrodes, 22.76% MCA and 0.108% DCA are formed.

Example 9

Chlorination of Acetic Acid using HCl with Potassium Chloride as Electrolyte

In a reactor vessel containing graphite anodes and cathodes (material type 6503 Le Carbonne Lorraine, Rotterdam, The Netherlands) with 580 $cm^2$ of effective anode area and 530 $cm^2$ of effective cathode area, an amount of 808 grams of mixture containing 10% anhydrous potassium chloride, 24% acetyl chloride, and 66% acetic acid (Fluka no. 00990, >99%) was preheated to 70° C. and electrolyzed at an average current of 10 amperes. During the electrolysis process hydrogen chloride gas was added to the reaction mixture. Samples taken from the electrolyte during the electrolysis process were analyzed by high performance liquid chromatography (HPLC). After passing 57.7 A-h of charge through the electrodes, 13.39% MCA and 0.57% DCA are formed.

Example 10

Chlorination of Acetic Acid using Trichloroacetic Acid and HCl

In a reactor vessel containing graphite anodes and cathodes (material type 6503 Le Carbonne Lorraine, Rotterdam, The Netherlands) with 580 $cm^2$ of effective anode area and 530 $cm^2$ of effective cathode area, an amount of 808 grams of mixture containing 11.9% trichloroacetic acid (TCA), 4.8% anhydrous lithium chloride, 11.9% acetyl chloride, and 71.4% acetic acid (Fluka no. 00990, >99%) was preheated to 70° C. and electrolyzed at an average current of 30 amperes. During the electrolysis process hydrogen chloride gas was added to the reaction mixture. Samples taken from the electrolyte during the electrolysis process were analyzed by high performance liquid chromatography (HPLC).

The results in Table 5 show that at the end of the process the DCA and TCA contents have both decreased and the MCA content has increased.

TABLE 5

Monochloroacetic acid (MCA), dichloroacetic acid (DCA), and trichloroacetic acid (TCA) concentrations of Example 10 measured by HPLC (in wt % relative to the sum of the amounts of acetic acid (HAc), MCA, TCA, and DCA) versus the amount of electric charge transferred during the process

| A-h | MCA content (%) | DCA content (%) | TCA content (%) |
|---|---|---|---|
| 0 | 0.13 | 0.00 | 13.32 |
| 16 | 3.69 | 2.85 | 9.47 |
| 30.5 | 7.34 | 5.13 | 5.99 |
| 47.5 | 11.69 | 6.51 | 3.18 |
| 63.5 | 16.04 | 6.82 | 1.51 |
| 86 | 22.00 | 5.96 | 0.42 |
| 118.5 | 30.00 | 3.96 | 0.05 |
| 135.5 | 33.96 | 3.01 | 0.02 |
| 152 | 37.33 | 2.19 | 0.01 |
| 170 | 40.51 | 1.50 | 0.00 |
| 186 | 43.33 | 1.06 | 0.00 |
| 211.5 | 47.18 | 0.63 | 0.00 |

Example 11

Reduction of Mother Liquor with Lithium Chloride as Electrolyte (Chlorination of Acetic Acid using Dichloroacetic Acid, and HCl)

In a reactor vessel containing graphite anodes and cathodes (material type 6503 Le Carbonne Lorraine, Rotterdam, The Netherlands) with 580 $cm^2$ of effective anode area and 530 $cm^2$ of effective cathode area, an amount of 1,007 grams of mixture containing 30% dichloroacetic acid (DCA), 5% anhydrous lithium chloride, 15% acetyl chloride, 30% monochloracetic acid (MCA), and 20% acetic acid (Fluka no. 00990, >99%) was preheated to 70° C. and electrolyzed at an average current of 30 amperes. During the electrolysis process hydrogen chloride gas was added to the reaction mixture.

Samples taken from the electrolyte during the electrolysis process were analyzed by high performance liquid chromatography (HPLC). The results in Table 6 show that at the end of the process the HAc and DCA contents have both decreased whereas the MCA content has increased.

TABLE 6

Monochloroacetic acid (MCA), dichloroacetic acid (DCA), and acetic acid (HAc) concentrations of Example 11 measured by HPLC (in wt % relative to the sum of the amounts of HAc, MCA, and DCA) versus the amount of electric charge transferred during the process

| A-h | MCA content (%) | DCA content (%) | HAc content (%) |
|---|---|---|---|
| 0 | 32.34 | 32.48 | 35.18 |
| 208 | 75.33 | 8.34 | 16.33 |

Example 12

Reduction of Mother Liquor with Calcium Chloride as Electrolyte (Chlorination of Acetic Acid using Dichloroacetic Acid and HCl)

In a reactor vessel containing graphite anodes and cathodes (material type 6503 Le Carbonne Lorraine, Rotterdam, The Netherlands) with 580 $cm^2$ of effective anode area and 530 $cm^2$ of effective cathode area, an amount of 1,007 grams of mixture containing 30% dichloroacetic acid (DCA), 5% anhydrous calcium chloride, 15% acetyl chloride, 30% monochloracetic acid (MCA), and 20% acetic acid (Fluka no. 00990, >99%) was preheated to 70° C. and electrolyzed at an average current of 30 amperes. During the electrolysis process hydrogen chloride gas was added to the reaction mixture.

Samples taken from the electrolyte during the electrolysis process were analyzed by high performance liquid chromatography (HPLC). The results in Table 7 show that at the end of the process the HAc and DCA contents have both decreased whereas the MCA content has increased.

TABLE 7

Monochloroacetic acid (MCA), dichloroacetic acid (DCA), and acetic acid (HAc) concentrations of Example 12 measured by HPLC (in wt % relative to the sum of the amounts of HAc), MCA, and DCA) versus the amount of electric charge transferred during the process

| A-h | MCA content(%) | DCA content (%) | HAc content (%) |
|---|---|---|---|
| 0 | 32.08 | 32.17 | 35.75 |
| 216 | 71.63 | 10.76 | 17.25 |

Example 13

Reduction of Mother Liquor with Magnesium Chloride as Electrolyte (Chlorination of Acetic Acid using Dichloroacetic Acid and HCl)

In a reactor vessel containing graphite anodes and cathodes (material type 6503 Le Carbonne Lorraine, Rotterdam, The Netherlands) with 580 $cm^2$ of effective anode area and 530 $cm^2$ of effective cathode area, an amount of 1007 grams of mixture containing 30% dichloroacetic acid (DCA), 5.2% anhydrous magnesium chloride, 15% acetyl chloride, 30% monochloracetic acid (MCA) and 20% acetic acid (Fluka no. 00990, >99%) was preheated to 70° C. and electrolyze at an average current of 30 amperes. During the electrolysis process, hydrogen chloride gas was added to the reaction mixture. Samples taken from the electrolyte during the electrolysis process were analyzed by high performance liquid chromatography (HPLC). The results in Table 8 show that at the end of the process both HAc and DCA contents are decreased whereas MCA content has increased.

TABLE 8

Monochloroacetic acid (MCA), dichloroacetic acid (DCA) and acetic acid (HAc) concentrations of example 13 measured by HPLC (in wt % relative to the sum of the amounts of HAc), MCA, and DCA) versus the amount of electric charge transferred during the process.

| A-h | MCA content (%) | DCA content (%) | HAc content (%) |
|---|---|---|---|
| 0 | 32.67 | 32.76 | 34.57 |
| 186 | 67.32 | 11.34 | 18.28 |

Example 14

Chlorination of Acetic Acid using HCl with Zinc Chloride as Electrolyte

In a reactor vessel containing graphite anodes and cathodes (material type 6503 Le Carbonne Lorraine, Rotterdam, The Netherlands) with 580 $cm^2$ of effective anode area and 530 $cm^2$ of effective cathode area, an amount of 1,607 grams of mixture containing 5% anhydrous zinc chloride, 13% acetyl chloride, and 82% acetic acid (Fluka no. 00990, >99%) was preheated to 70° C. and electrolyzed at an average current of 25 amperes. During the electrolysis process hydrogen chloride gas was added to the reaction mixture. Samples taken from the electrolyte during the electrolysis process were analyzed by high performance liquid chromatography (HPLC). After passing 162 A-h of charge through the electrodes, 15.67% MCA and 0.10% DCA are formed.

Example 15

Chlorination of Acetic Acid with Iron (III) Chloride as Electrolyte

In a reactor vessel containing graphite anodes and cathodes (material type 6503 Le Carbonne Lorraine, Rotterdam, The Netherlands) with 580 $cm^2$ of effective anode area and 530 $cm^2$ of effective cathode area, an amount of 1,607 grams of mixture containing 5% anhydrous iron (III) chloride, 13% acetyl chloride, and 82% acetic acid (Fluka no. 00990, >99%) was preheated to 70° C. and electrolyzed at an average current of 30 amperes. During the electrolysis process hydrogen chloride gas was added to the reaction mixture. Samples taken from the electrolyte during the electrolysis process were analyzed by high performance liquid chromatography (HPLC). After passing 192 A-h of charge through the electrodes, 4.73% MCA and 0.10% DCA are formed.

Example 16

Chlorination of Acetic Acid using HCl with Aluminium Chloride as Electrolyte

In a reactor vessel containing graphite anodes and cathodes (material type 6503 Le Carbonne Lorraine, Rotterdam, The Netherlands) with 580 $cm^2$ of effective anode area and 530 $cm^2$ of effective cathode area, an amount of 1,607 grams of mixture containing 5% anhydrous aluminium chloride, 13% acetyl chloride, and 82% acetic acid (Fluka no. 00990, >99%) was preheated to 70° C. and electrolyzed at an average current of 30 amperes. During the electrolysis process hydrogen chloride gas was added to the reaction mixture. Samples taken from the electrolyte during the electrolysis process were analyzed by high performance liquid chromatography (HPLC). After passing 119 A-h of charge through the electrodes, 12.29% MCA and 0.02% DCA are formed.

Example 17

Chlorination of Dimethylpentanone using HCl

In a reactor vessel containing graphite anodes and cathodes (material type 6503 Le Carbonne Lorraine, Rotterdam, The Netherlands) with 47 $cm^2$ of effective anode area and 16 $cm^2$ of effective cathode area, an amount of 61 grams of mixture containing 6% anhydrous lithium chloride, 94% 2,4-dimethylpentanone was preheated to 70° C. and electrolyzed at an average current of 0.3 amperes. During the electrolysis process, hydrogen chloride gas was added to the reaction mixture. Samples taken from the electrolyte during the electrolysis process were analyzed by NMR.

The results in Table 10 show that at the end of the process 2-chloro-2,4-dimethylpentanone is formed.

TABLE 10

| Concentrations of 2,4-dimethylpentanone and 2-chloro-2,4-dimethyl-pentanone from Example 17 measured by NMR in mole % | | |
|---|---|---|
| A-h | 2,4-dimethylpentanone | 2-chloro-2,4-dimethylpentanone |
| 0 | 100 | 0.00 |
| 6 | 98.5 | 1.5 |

Comparative Example 18

Fluorination of Acetic Acid using Trifluoroacetic Acid (TFA)

In a reactor vessel containing graphite anodes and cathodes (material type 6503 Le Carbonne Lorraine, Rotterdam, The Netherlands) with 47 $cm^2$ of effective anode area and 16 $cm^2$ of effective cathode area, an amount of 99 grams of mixture containing 4% anhydrous lithium chloride, 35.4% TFA, 35.4% acetic acid, and 25.2% acetyl chloride was preheated to 70° C. and electrolyzed at an average current of 2 amperes. Samples taken from the electrolyte during the electrolysis process were analyzed by NMR. In the samples no evidence was found for the formation of monofluoroacetic acid or difluoroacetic acid. Only MCA and small amounts of DCA were found.

Comparative Example 19

Fluorination of Acetic Acid using KF

In a reactor vessel containing graphite anodes and cathodes (material type 6503 Le Carbonne Lorraine, Rotterdam, The Netherlands) with 47 $cm^2$ of effective anode area and 16 $cm^2$ of effective cathode area, an amount of 99 grams of mixture containing 4.3% anhydrous potassium fluoride, 68.5% acetic acid, and 27.2% acetyl chloride was preheated to 70° C. and electrolyzed at an average current of 0.4 amperes. Samples taken from the electrolyte during the electrolysis process were analyzed by NMR. In the samples no evidence was found for the formation of monofluoroacetic acid or difluoroacetic acid. Only MCA and small amounts of DCA were found.

Example 20

Chlorination of Dodecanoic Acid using HCl with LiCl as Electrolyte

In a reactor vessel containing graphite anodes and cathodes (material type 6503 Le Carbonne Lorraine, Rotterdam, The Netherlands) with 47 $cm^2$ of effective anode area and 16 $cm^2$ of effective cathode area, an amount of 92 grams of mixture containing 4.9% anhydrous lithium chloride, 35.3% acetic acid, 35.3% dodecanoic acid, and 24.5% acetyl chloride was preheated to 70° C. and electrolyzed at an average current of 1 amperes. Samples taken from the electrolyte during the electrolysis process were analyzed by NMR. After passing 3.4 A-h of charge through the electrodes, 1.3 mole % of 2-chloro-dodecanoic acid is formed.

Example 21

Chlorination of Octadecanoic Acid using HCl

In a reactor vessel containing graphite anodes and cathodes (material type 6503 Le Carbonne Lorraine, Rotterdam, The Netherlands) with 47 $cm^2$ of effective anode area and 16 $cm^2$ of effective cathode area, an amount of 92 grams of mixture containing 4.7% anhydrous lithium chloride, 38.3% acetic acid, 33.6% octadecanoic acid, and 23.4% acetyl chloride was preheated to 70° C. and electrolyzed at an average current of 1 amperes. Samples taken from the electrolyte during the electrolysis process were analyzed by NMR. After passing 3.2 A-h of charge through the electrodes, 1.3 mole % of 2-chloro-octadecanoic acid is formed.

The invention claimed is:

1. A process to prepare a halogenated carbonyl group-containing compound, the process comprising: electrochemically reacting a corresponding carbonyl group-containing compound further containing an α-carbon hydrogen atom with a di- and/or higher halogenated carbonyl group-containing compound, optionally a hydrogen halide H—X, an organic halide R'—X and/or a halide salt $M^{n+}$—$X_n^-$ under substantially water-free conditions, wherein X is a chlorine, bromine or iodine atom, R' is an alkyl or aryl group that may be linear or branched, optionally containing one or more heteroatoms of which the halogen atom X can be electrochemically split off, $M^{n+}$ is a quaternary ammonium, alkaline earth metal, alkali metal or metal cation, and n is an integer of 1 to 5, depending on the valency of the metal cation $M^{n+}$.

2. The process of claim 1 wherein the halogenated carbonyl group-containing compound that is prepared is a monohalogenated compound.

3. The process of claim 2 wherein the halogenated carbonyl group-containing compound that is prepared is halogenated at the α-carbon atom.

4. The process according to claim 2 wherein additionally a supporting electrolyte is present in the electrochemical reaction.

5. The process according to claim 4 wherein the supporting electrolyte is a chlorine salt.

6. The process according to claim 2 wherein additionally a catalyst selected from the group consisting of acyl halides and carboxylic anhydrides is added to the electrochemical reaction.

7. The process of claim 1 wherein the halogenated carbonyl group-containing compound that is prepared is halogenated at the α-carbon atom.

8. The process of claim 1, further comprising: prior to the electrochemically reacting step, chemically reacting the corresponding carbonyl group-containing compound with chlorine, bromine or iodine molecules.

9. The process of claim 8 wherein the halogenated carbonyl group-containing compound that is prepared is a monohalogenated compound.

10. The process according to claim 8 wherein X is a chlorine atom.

11. The process according to claim 8 wherein the corresponding carbonyl group-containing compound is acetic acid or propanoic acid or a fatty acid.

12. The process of claim 8, wherein the process occurs in the substantial absence of any solvent.

13. The process according to claim 1 wherein X is a chlorine atom.

14. The process according to claim 1 wherein the corresponding carbonyl group-containing compound is acetic acid or propanoic acid or a fatty acid.

15. The process according to claim 1 wherein additionally a supporting electrolyte is present in the electrochemical reaction.

16. The process according to claim 15 wherein the supporting electrolyte is a chlorine salt.

17. The process according to claim 1 wherein additionally a catalyst selected from the group consisting of acyl halides and carboxylic anhydrides is added to the electrochemical reaction.

18. The process of claim 1, wherein the process occurs in the substantial absence of any solvent.

19. A process to prepare a halogenated carbonyl group-containing compound, the process comprising:

separating a monohalogenated carbonyl group-containing compound from a reaction mixture containing both the monohalogenated carbonyl group-containing compound and a di- and/or higher halogenated carbonyl group-containing compound to form a mother liquor; and in the mother liquor, electrochemically reacting a corresponding carbonyl group-containing compound further containing an α-carbon hydrogen atom with the di- and/or higher halogenated carbonyl group-containing compound, optionally a hydrogen halide H—X, an organic halide R'—X and/or a halide salt $M^{n+}$—$X_n^-$ under substantially water-free conditions, wherein X is a chlorine, bromine or iodine atom, R' is an alkyl or aryl group that may be linear or branched, optionally containing one or more heteroatoms of which the halogen atom X can be electrochemically split off, $M^{n+}$ is a quaternary ammonium, alkaline earth metal, alkali metal or metal cation, and n is an integer of 1 to 5, depending on the valency of the metal cation $M^{n+}$.

20. The process of claim 19 wherein additional carbonyl group-containing compound is added.

* * * * *